United States Patent [19]

Bowe et al.

[11] Patent Number: 4,887,628

[45] Date of Patent: Dec. 19, 1989

[54] FLUIDIC APPARATUS

[75] Inventors: Michael J. Bowe; Alistair L. Wright, both of Preston, United Kingdom

[73] Assignee: United Kingdom Atomic Energy Authority, London, United Kingdom

[21] Appl. No.: 236,015

[22] Filed: Aug. 24, 1988

[30] Foreign Application Priority Data

Aug. 28, 1987 [GB] United Kingdom ..... 8720300
Oct. 23, 1987 [GB] United Kingdom ..... 8724918

[51] Int. Cl.[4] ..... F15C 1/16

[52] U.S. Cl. ..... 137/8; 137/810; 137/813; 137/565; 417/43

[58] Field of Search ..... 137/810, 813, 565, 1, 137/2, 8; 417/43

[56] References Cited

U.S. PATENT DOCUMENTS

| | | | |
|---|---|---|---|
| 1,192,965 | 5/1970 | Tiley . | |
| 3,324,891 | 6/1967 | Rhoades | 138/33 |
| 3,410,287 | 11/1968 | Der Heyden et al. | 137/810 |
| 3,417,772 | 12/1968 | Schaeffer | 137/810 |
| 3,515,158 | 6/1970 | Utz | 137/812 |
| 3,545,468 | 12/1970 | Freeman | 137/810 |
| 3,628,563 | 12/1971 | Tomita | 137/565 |
| 3,645,094 | 2/1972 | Suggs | 137/810 |
| 3,654,943 | 4/1972 | Rexford | 137/9 |
| 3,674,044 | 7/1972 | Mayer | 137/813 |
| 3,674,045 | 7/1972 | Millmaw et al. | 137/813 |
| 3,707,159 | 12/1972 | Eastman | 137/810 |
| 3,942,557 | 3/1976 | Tsuchiya | 137/810 |
| 4,126,156 | 11/1978 | Barnes | 137/810 |

*Primary Examiner*—A. Michael Chambers
*Attorney, Agent, or Firm*—King and Schickli

[57] ABSTRACT

A vortex amplifier functions as a choke valve to control flow in a flow line from, for example, a gas or oil well. The vortex amplifier is arranged in the flow line such that flow passes radially through the vortex amplifier to emerge at an axial port. A control flow is introduced tangentially into the vortex amplifier along a line by a pump. The pump is regulated by a transducer responsive to signals generated by the flow in the flow line.

4 Claims, 1 Drawing Sheet

FLUIDIC APPARATUS

The present invention concerns fluidic apparatus for the control of fluid flows.

BACKGROUND OF THE DISCLOSURE

In the oil industry, for example, choke valves are used to control or throttle fluid flows from oil or gas fields whereby to maintain a substantially constant flow rate irrespective of pressure fluctuations in the flow line. The fluid flow can be a mixture of oil, gas and solid particles, such as sand, and such a multi-phase flow provides an extremely harsh and abrasive medium for conventional choke valves which rely on movable components to control flow.

The aim of the invention is to provide a control arrangement which does not utilise a conventional valve but rather relies upon a fluidic device known as a vortex amplifier which does not have moving parts and seals which suffer wear and corrosion during use. A vortex amplifier comprises a vortex chamber through which a main flow passes radially to emerge at an axial outlet. The main flow can be regulated and controlled by a control flow introduced tangentially into the vortex chamber.

FEATURES AND ASPECTS OF THE INVENTION

According to the present invention a fluidic apparatus for the control of flow in a fluid flow line comprises a vortex amplifier included in the flow line and sensing means responsive to variations in flow in the flow line to regulate a control flow to the vortex amplifier.

The sensing means can comprise a pressure transducer controlling a pump for the control flow. Conveniently the transducer communicates with the flow line downstream of the vortex amplifier and can control the pump such that a substantially constant pressure is maintained in the flow line.

The control flow can be taken from the main flow at a position upstream or downstream of the vortex amplifier. Alternatively a separate source of control fluid can be pumped to the vortex amplifier. For example, in the control of an undersea oil well in which the vortex amplifier is included in the flow line from the well the control fluid can be seawater. The control fluid can effect shut-off of the main flow, an attractive feature for oil pipeline use in the event of an emergency.

The fluid, both in the main flow and the control flow can be a gas or liquid.

DESCRIPTION OF THE DRAWINGS

The invention will be described, by way of example, with reference to the accompanying drawings; in which.

DESCRIPTION OF THE PREFERRED EMBODIMENTS

Figure 1:
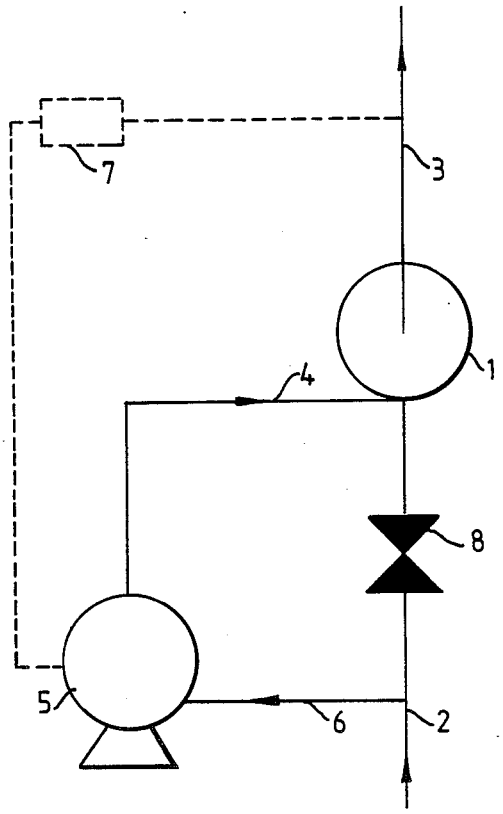
FIG. 1 illustrates a first embodiment for controlling flow in an oil or gas line.

In FIG. 1, a vortex amplifier 1 is included in a flow line 2 leading from an oil well (not shown). The line 2 communicates with a radial port of the vortex amplifier and the axial port of the vortex amplifier communicates with a flow line 3 leading to a well head or processing plant (not shown). A further line 4 communicates with a tangential control port of the vortex amplifier. The line 4 is connected to a multi-phase pump 5 which in turn is connected by line 6 to the flow line 2 at a position upstream of the vortex amplifier. The pump 5 is operable under the control of a pressure transducer 7 which senses pressure variations in the line 3 at a position downstream of the vortex amplifier and transmits control signals to the pump 5. A closure valve 8 can be included in the line 2 between the vortex amplifier and the line 6. The valve 8 is normally in a fully open condition and is only operated when it is required to completely close and isolate the line 2.

The flow in line 2 enters the chamber of the vortex amplifier in a radial direction and leaves the chamber through an axial outlet and along line 3 with very little pressure loss. Control flow along the line 4 is admitted into the chamber tangentially and deflects the inlet flow into a vortex so reducing the inlet flow. Increasing the control flow increases the pressure drop caused by the vortex and the main flow can be progressively decreased to reduce the main flow outlet to zero.

The vortex amplifier 1 functions as a choke valve in the flow line and it is possible to maintain a substantially constant pressure in the downstream end of the line irrespective of pressure changes upstream of the choke valve. This is important in the oil industry to prevent fluctuations at the receiving or collecting end of a flow line arising from pressure changes and surges at a well head and in particular where a number of oil wells feed into a common manifold at which the pressure should be held constant.

The pressure downstream of the vortex amplifier is monitored and changes in pressure are detected and converted into signals by the transducer 7 to control operation of the pump 5. The control flow delivered by the pump along line 4 determines the flow through the vortex amplifier 1. The control flow is taken from the line 2 and is the same fluid as the main fluid flow although at an increased pressure due to the action of the pump. Contrary to a conventional choke valve the vortex amplifier at all times presents a constant flow area to the main flow and throttling is achieved by the control flow.

Figure 2:
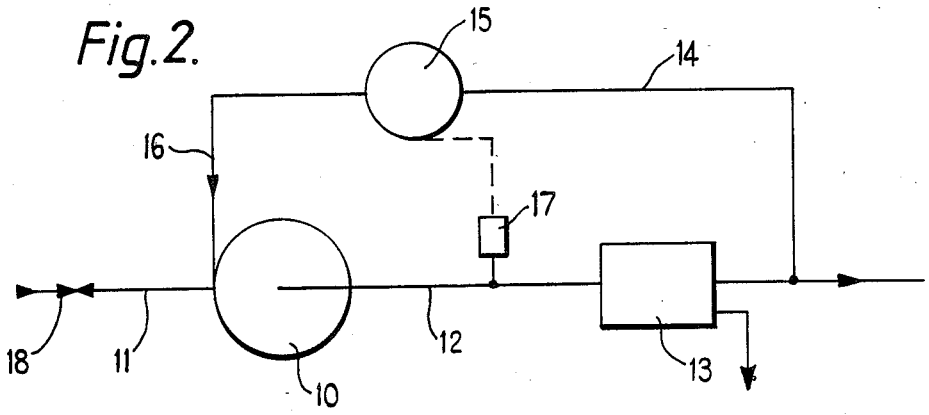
FIG. 2 illustrates a second embodiment of the invention.

In FIG. 2, a vortex amplifier 10 comprises a chamber having radial, axial and tangential ports and is included in a flow line 11 leading, for example, from an oil well. The flow line 11 communicates with the radial port of the vortex amplifier. The axial port of the vortex amplifier communicates with flow line 12 which can lead, for example, to a platform positioned above the oil well. The flow direction is indicated by the arrows. A multiphae separator 13 can be included in the line 12. The separator functions to separate the multiphase flow from the well into its separate constituents whereby the flow from the separator to the platform comprises a clean oil.

A branch 14 from the line 12 at a position downstream of the separator 13 leads to a pump 15 and the output of the pump 15 is connected by line 16 to the control port or ports of the vortex amplifier. The pump 15 can be controlled by a pressure transducer 17 which senses pressure variations in the line 12 and transmits control signals to the pump. A control valve 18 can be included in the flow line 11.

The clean oil drawn along the branch 14 and pumped to the control port or ports of the vortex amplifier determines and controls the main flow along the line 12 leading to the platform.

In the illustrated examples the control flow is a branch of the main flow and is delivered by the pump to the control port or ports of the vortex amplifier at a pressure higher than the pressure of the main flow at the radial inlet to the vortex amplifier. As an alternative the control flow can be pumped from a separate source of the same or a different fluid to the main flow. For example and with reference to FIG. 1, when an oil flow in line 2 is from beneath the sea bed, the line 6 can be omitted and the pump 5 can pump sea water along the line 4 to control the flow through the vortex amplifier. The control flow along the line 4 can be such as to reduce the oil flow to zero and to function as a shut-off valve.

We claim::

1. A method of controlling flow in a flow line which comprises inserting a vortex amplifier in the flow line such that flow enters radially into the chamber of the vortex amplifier and emerges axially from the chamber, arranging a pump to deliver a control flow to the vortex amplifier and locating a pressure transducer in the flow line downstream of the vortex amplifier, utilizing signals generated by the pressure transducer in response to pressure changes in the flow line to control operation of the pump whereby to vary the control flow in response to changes in the pressure to thereby maintain a substantially constant pressure in the flow line downstream of the vortex amplifier.

2. A method according to claim 1 which comprises connecting inlet to the pump to the flow line at a position upstream of the vortex amplifier.

3. A method according to claim 1 which comprises connecting the pump to the flow line at a position downstream of the vortex amplifier.

4. A method according to claim 1 which comprises including a multi-phase separator in the flow line downstream of the vortex amplifier.

* * * * *